US005215066A

United States Patent [19]

Narishige et al.

[11] Patent Number: 5,215,066

[45] Date of Patent: Jun. 1, 1993

[54] IGNITION APPARATUS FOR AN INTERNAL COMBUSTION ENGINE

[75] Inventors: Takafumi Narishige; Shingo Morita; Mitsuru Koiwa, all of Himeji, Japan

[73] Assignee: Mitsubishi Denki Kabushiki Kaisha, Tokyo, Japan

[21] Appl. No.: 959,404

[22] Filed: Oct. 13, 1992

[30] Foreign Application Priority Data

Oct. 15, 1991 [JP] Japan ..... 3-265728
Oct. 15, 1991 [JP] Japan ..... 3-265732

[51] Int. Cl.[5] ..... F02P 3/08

[52] U.S. Cl. ..... 123/620; 123/597; 123/604; 123/623; 123/656

[58] Field of Search ..... 123/596, 597, 604, 605, 123/620, 623, 625, 656

[56] References Cited

U.S. PATENT DOCUMENTS 4,122,816 10/1978 Fitzgerald et al. ..... 123/620 X
4,293,797 10/1981 Gerry ..... 123/620 X
4,733,646 3/1988 Iwasaki ..... 123/597
4,782,242 11/1988 Kovacs ..... 123/620 X
5,163,411 11/1992 Koiwa et al. ..... 123/605

FOREIGN PATENT DOCUMENTS 14820 4/1978 Japan .
30591 7/1978 Japan .
51953 12/1978 Japan .
59376 4/1983 Japan ..... 123/620

*Primary Examiner*—Willis R. Wolfe
*Attorney, Agent, or Firm*—Sughrue, Mion, Zinn, Macpeak and Seas

[57] ABSTRACT

An LCDI-type ignition apparatus for an internal combustion engine includes first and second capacitors connected to an ignition coil and a voltage source for generating a charging voltage for the capacitors. The first capacitor is for producing an initial discharge of a spark plug, and the second capacitor is for lengthening the discharge of the spark plug after discharge has been initiated by the first capacitor. In one form of the invention, the second capacitor is charged only after the first capacitor has been charged by the voltage source to a prescribed voltage sufficient to produce a suitable discharge of the spark plug. As a result, even when the engine is operating at a high rotational speed and the time between consecutive firings of the engine is small, an adequate ignition voltage can be obtained. In another form of the invention, the charging voltage(s) of one or both of the capacitors is or are varied in accordance with the one or more engine operating conditions. Each charging voltage can be controlled to the minimum necessary value based on the present engine operating conditions.

14 Claims, 7 Drawing Sheets

IGNITION APPARATUS FOR AN INTERNAL COMBUSTION ENGINE

BACKGROUND OF THE INVENTION

This invention relates to an apparatus for producing ignition in an internal combustion engine.

Capacitive discharge ignition (CDI) is an ignition arrangement for internal combustion engines in which ignition is produced when a voltage stored in a capacitor is discharged through the primary winding of an ignition coil. In order to prevent misfiring of an engine, such as when the engine is starting or is cold, an ignition arrangement referred to as long-duration capacitive discharge ignition (LCDI) has been developed. An LCDI system employs first and second capacitors. The first capacitor is connected directly to the primary winding of an ignition coil and is used to initiate discharge, while the second capacitor is connected to the primary winding through an induction coil and is used to lengthen discharge. The capacitors are both charged to a desired voltage, and when it is desired to ignite a cylinder of the engine, the capacitors are discharged. The energy released from the first capacitor into the primary winding initiates discharge of a spark plug of the engine, while a portion of the energy released from the second capacitor is stored in the induction coil. When the capacitors have discharged, the energy stored in the induction coil is then released into the primary winding of the ignition coil, thereby significantly lengthening the discharge time of the spark plug. For example, the discharge time of a spark plug on an LCDI system can be increased from about 100 microseconds to about 1.5 milliseconds compared to the discharge time in a CDI system without a second capacitor and an induction coil.

In a conventional LCDI system, the second capacitor for lengthening the discharge time is always charged to the same voltage, regardless of the operating conditions of the engine. However, the amount of lengthening of the discharge required to prevent misfiring will vary with the engine operating conditions. For example, at a steady engine speed, less lengthening of the discharge time is required than when the engine is just starting and the engine rotational speed is unstable. Therefore, in a conventional LCDI system, the second capacitor may be charged to a greater voltage than required, so electrical power consumption is unnecessarily high. As a result, the amount of heat generated and the size of the ignition apparatus in order to cope with the generated heat are large.

Another problem with conventional LCDI systems is that at high engine speeds, there may not be enough time between the firing of consecutive cylinders to charge both capacitors to the voltage necessary to obtain good ignition, and the likelihood of misfiring increases.

SUMMARY OF THE INVENTION

Accordingly, it is an object of the present invention to provide an ignition apparatus for an internal combustion engine which has reduced power consumption.

It is another object of the present invention to provide an ignition apparatus of reduced size.

It is yet another object of the present to prove an ignition apparatus which can provide good ignition at high engine speeds.

An ignition apparatus according to the present invention is of the LCDI type and includes first and second capacitors connected to an ignition coil and voltage generating means for generating a charging voltage for the capacitors. The first capacitor is for producing initial discharge of a spark plug, and the second capacitor is for lengthening the discharge of the spark plug after discharge has been initiated by the first capacitor. In one form of the present invention, the second capacitor is charged only after the first capacitor has been charged by the voltage generating means to a prescribed voltage sufficient to produce a suitable discharge of the spark plug. As a result, even when the engine is operating at a high rotational speed and the time between consecutive firings of the engine is small, an adequate ignition voltage can be obtained and misfiring can be prevented.

In another form of the present invention, the charging voltage of the second capacitor for lengthening the discharge is varied in accordance with an engine operating condition. The charging voltage can be set to the minimum voltage necessary for the operating conditions. As a result, power consumption by the ignition apparatus can be reduced, and the size of the ignition apparatus can be accordingly reduced.

In yet another form of the present invention, the charging voltage of the first capacitor is varied in accordance with an engine operating condition.

DESCRIPTION OF THE PREFERRED EMBODIMENTS

A number of preferred embodiments of an ignition apparatus according to the present invention will be described with reference to the accompanying drawings.

Figure 1:
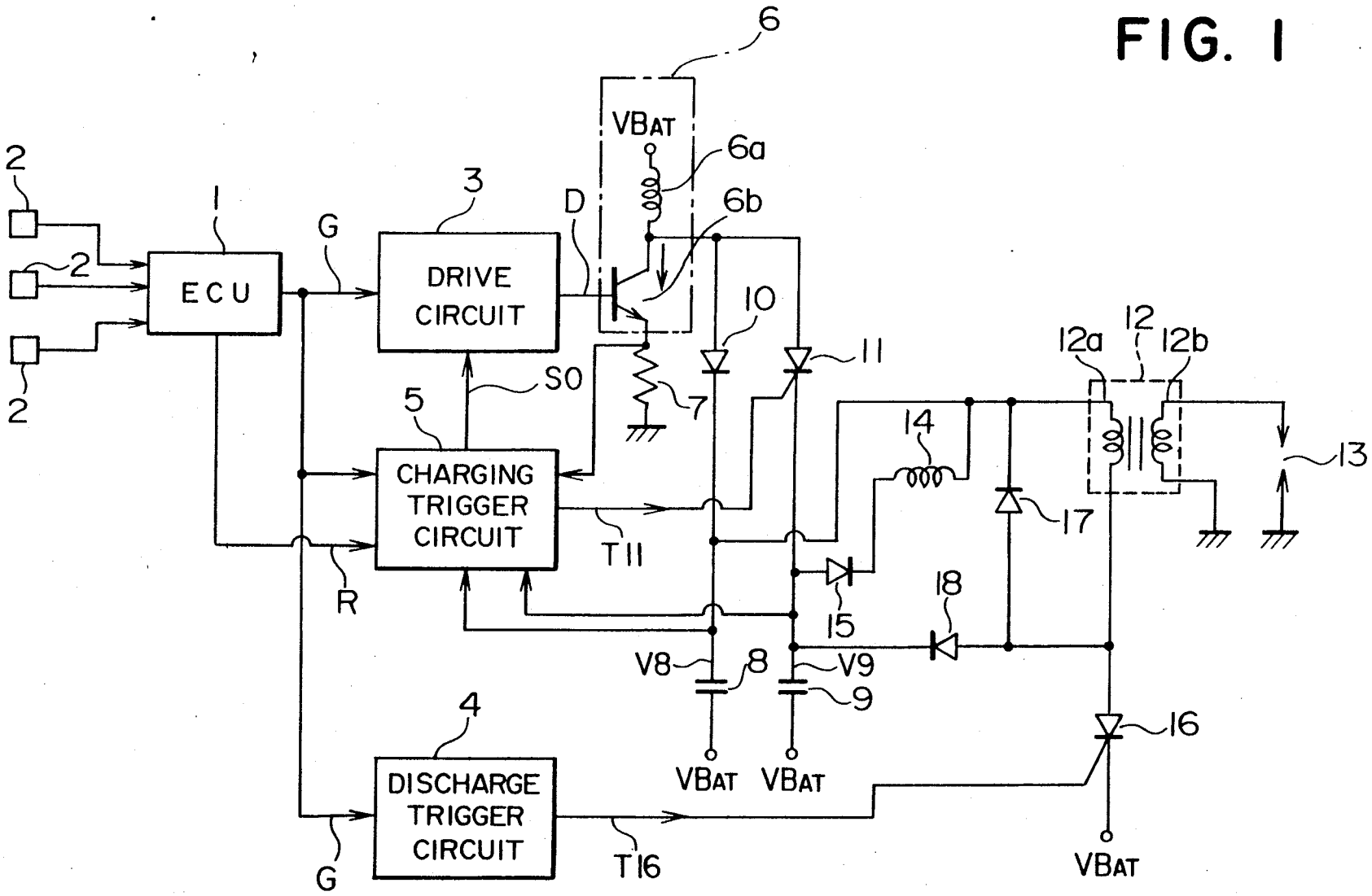
FIG. 1 is a schematic diagram of a first embodiment of an ignition apparatus according to the present invention.

FIG. 1 schematically illustrates a first embodiment as applied to an internal combustion engine of one or more cylinders for an automotive vehicle. The operation of this embodiment is controlled by an electronic control unit (ECU) 1 which is powered by an unillustrated battery generating a voltage $V_{BAT}$. The ECU 1 receives input signals from one or more conventional sensors 2 which sense various operating conditions of the engine or other portions of the vehicle. On the basis of these input signals, the ECU 1 calculates a suitable ignition timing and generates an ignition signal G. The operating conditions detected by the sensors 2 are not limited to any particular ones, and any operating conditions conventionally used to calculate ignition timing can be employed. Algorithms for calculating ignition timing are well known to those skilled in the art and therefore will not be described here. The ECU 1 also generates an operating condition signal R indicating an operating condition of the engine, which in this embodiment is the engine rotational speed, but which can be indicative of a different condition, such as the engine load or the engine coolant temperature. Alternatively, the ECU 1 may generate a plurality of different operating condition signals indicating various operating conditions. The types of sensors 2 which are employed will depend on the nature of the operating condition signal and on the conditions which are used to calculate the ignition timing.

The ignition signal G is input to a drive circuit 3, a discharge trigger circuit 4, and a charging trigger circuit 5. Each time the drive circuit 3 receives the ignition signal G from the ECU 1, it generates a drive signal D in the form of a train of pulses which control the operation of a voltage step-up circuit 6.

The discharge trigger circuit 4 generates a trigger signal T16 upon the falling edge of the ignition signal G and applies the trigger signal T16 to the gate of a switching element in the form of a thyristor 16.

The voltage step-up circuit 6 increases the battery voltage $V_{BAT}$ to a voltage suitable for charging first and second capacitors 8 and 9. Any means capable of increasing a DC voltage can be employed as the voltage step-up circuit 6. In the present embodiment, the voltage step-up circuit 6 comprises a voltage step-up coil **6*a* and a power transistor 6*b* gated by the drive signal D. The voltage step-up coil 6*a* has a first end to which the battery voltage $V_{BAT}$ is applied and a second end connected to the collector of the power transistor 6*b*. The base of the power transistor 6*b* is connected to an output terminal of the drive circuit 3 and receives the drive signal D, and its emitter is connected to one end of a current sensing resistor 7, the other end of which is grounded. When the drive signal D has a high level, the power transistor 6*b* is turned on and enables current to flow through the voltage step-up coil 6*a***.

The collector of the power transistor **6*b* is connected to one terminal (referred to as the charging terminal) of the first capacitor 8 through a diode 10 and to one terminal (also referred to as the charging terminal) of the second capacitor 9 through a switching element in the form of a thyristor 11. The other terminals of capacitors 8 and 9 receive the battery voltage $V_{BAT}$. Thyristor 11 is turned on and off by a trigger signal T11 generated by the charging trigger circuit 5. The second capacitor 9 can be charged by the voltage step-up circuit 6 only when thyristor 11 is turned on, thus enabling the charging voltages of the first and second capacitors 8 and 9 to be separately controlled. The voltages V8 and V9 at the charging terminals of the first and second capacitors 8 and 9 are input to the charging trigger circuit 5**.

Each cylinder of the engine is equipped with an ignition coil 12 (only one of which is shown) having a primary winding **12*a* and a secondary winding 12*b*. The charging terminal of the first capacitor 8 is directly connected to a first end of the primary winding 12*a*, while the charging terminal of the second capacitor 9 is connected to the first end of the primary winding 12*a* through an induction coil 14 for lengthening discharge and a diode 15 connected in series. The second end of the primary winding 12*a* is connected to the anode of thyristor 16, and the cathode of thyristor 16 is to the battery. The secondary winding 12*b* of the ignition coil 12 is connected between ground and a spark plug 13** of one of the cylinders.

A diode 17 is connected across the ends of the primary winding **12*a* to prevent current oscillations, and another diode 18 is connected between the anode of thyristor 16 and the charging terminal of the second capacitor 9**.

The charging trigger circuit 5 includes voltage sensing circuits for sensing the voltages V8 and V9 of capacitors 8 and 9. The trigger signal T11 for thyristor 11 is not generated until the charging trigger circuit 5 senses that voltage V8 has reached a prescribed voltage VA suitable for ignition. When the trigger signal T11 is generated, thyristor 11 is turned on and current from the voltage step-up circuit 6 flows into the second capacitor 9 to charge it. The charging voltage V9 of the second capacitor 9 is controlled by the charging trigger circuit 5 to a prescribed voltage VB determined by the engine operating conditions, as indicated by the operating condition signal R. When the charging trigger circuit 5 senses that voltage V9 has reached the prescribed voltage VB, it generates an off signal SO which is input to the drive circuit 3, which then stops generating the drive signal D, and the power transistor **6*b* of the voltage step-up circuit 6** is turned off.

The charging trigger circuit 5 also senses the voltage across resistor 7 indicating the current passing through the power transistor **6*b*. When this voltage reaches a predetermined level, the charging trigger circuit 5 temporarily generates the off signal SO to stop the generation of the drive signal D. After a predetermined time has elapsed as determined by an internal timer, for example, of the charging trigger circuit 5, the off signal SO is turned off so that the drive circuit 3 can again generate the drive signal D. In this manner, the power transistor 6*b*** can be protected from damage due to excessive current.

The trigger signal T11 for controlling thyristor 11 can have a variety of forms. For example, the trigger signal T11 can comprise a series of pulses, and the charging trigger circuit 5 can control the duty cycle of the pulses to adjust the charging voltage V9 of the second capacitor 9. Alternatively, trigger signal T11 can be a single long pulse, and the charging trigger circuit 5 can control the charging voltage V9 by controlling the time at which the trigger signal T11 is generated after voltage V8 reaches prescribed voltage VA.

The relationship between the engine operating condition indicated by the operating condition signal R and the charging voltage V9 of the second capacitor 9 is not restricted to a particular one. In general, there is greater need to lengthen the discharge time of the spark plug 13 when the engine speed is unstable (such as when the engine is starting or during sudden acceleration of the vehicle), than when it is stable. Therefore, when the charging trigger circuit 5 determines from the operating condition signal R that the engine speed is unstable, the charging trigger circuit 5 can increase the charging voltage V9, and it can decrease the charging voltage V9 when the engine speed is stable. In this case, a signal indicative of the engine speed, the engine load in the form of an intake air amount or the like can be used as the operating condition signal R. There is also greater need to lengthen the discharge time of the spark plug 13, when the engine is cold than when it is warm. Therefore, if the operating condition signal R is indicative of the engine temperature (such a signal indicating the engine coolant temperature), the charging trigger circuit 5 can be designed to increase the charging voltage V9 as the engine temperature decreases. Whatever the relationship between the engine operating conditions and the charging voltage V9, the charging voltage V9 can be set to the minimum necessary voltage based on the present engine operating conditions. If the charging trigger circuit 5 determines that the minimum necessary voltage is 0, trigger signal T11 will not be generated, and thyristor 11 will remain off, so the second capacitor 9 will not be charged.

The operation of the embodiment of FIG. 1 is as follows. It will be assumed that both of the first and second capacitors 8 and 9 have already been charged by the voltage step-up circuit 6 to the prescribed voltages VA and VB respectively. At an ignition timing determined by the ECU 1 based on the engine operating state, ECU 1 generates the ignition signal G in the form of a pulse. Upon the falling edge of this pulse, the discharge trigger circuit 4 generates trigger signal T16 having a high level, and trigger signal T16 turns on thyristor 16. When thyristor 16 is turned on, the voltage V8 of the first capacitor 8 is rapidly discharged through the primary winding 12*a* of the ignition coil 12 and thyristor 16. The current flowing through the primary winding 12*a* generates a high voltage in the secondary winding 12*b*, and this voltage initiates discharge of the spark plug 13.

At the same time that the first capacitor 8 discharges, the second capacitor 9 is discharged through diode 15, the induction coil 14, the primary winding 12*a* of the ignition coil 12, and thyristor 16. A portion of the discharged energy is stored in the induction coil 14. After the discharge of the first and second capacitors 8 and 9 is completed, the energy stored in the induction coil 14 produces a current which flows through the primary winding 12*a* of the ignition coil 12, and the resulting voltage generated in the secondary winding 12*b* lengthens the discharge time of the spark plug 13 in the same manner as in a conventional LCDI apparatus. Thyristor 16 is automatically turned off when the discharge currents from capacitors 8 and 9 fall below a predetermined threshold for maintaining thyristor 16 on.

After the capacitors 8 and 9 are discharged, they are recharged by the voltage generated by the voltage step-up circuit 6. The first capacitor 8 is first charged to prescribed voltage VA, and then the second capacitor 9 is charged to prescribed voltage VB determined by the charging trigger circuit 5 based on the operating condition signal R. Since the prescribed voltage VB can be set to the minimum necessary voltage for the present operating conditions, the second capacitor 9 is not overcharged, and the electrical power consumed by the apparatus can be reduced. The heat generated by the apparatus is therefore minimized, and the size of the apparatus can accordingly be reduced.

Furthermore, since the first capacitor 8 is charged before the second capacitor 9, the first capacitor 9 can always be charged to an adequate voltage and misfiring can be prevented even when the engine speed is high and there is little time for the capacitors to recharge.

Although in FIG. 1, an output current I from the voltage step-up circuit 6 is input to the charging trigger circuit 5 in order to operate it during a high level period of the drive signal D from the drive circuit 3, a drive signal D from the drive circuit 3 or an ignition signal G from the ECU 1 can be input to the charging trigger circuit 5 for the same purpose in place of the output current I of the voltage set-up circuit 6.

Further in FIG. 1, the voltage step-up coil 6*a*, the first and second capacitors 8 and 9, and thyristor 16 each have a terminal electrically connected to the positive terminal of the battery, but these terminals could instead be grounded.

Although in the above embodiment, the second capacitor 9 is charged to the minimum necessary voltage V9 under the control of a charging trigger signal T11, the charging trigger circuit 5 can be constructed such that it stops generation of the charging trigger signal T11 to turn the thyristor 11 off immediately when it determines based on the operating condition signal R that the engine operation is in a discharge-extension unnecessary range or in a stable operation range.

FIG. 1 illustrates only a single spark plug 13. When the embodiment of FIG. 1 is applied to a multi-cylinder engine, each cylinder is equipped with its own spark plug 13, ignition coil 12, and thyristor 16.

In the embodiment of FIG. 1, the charging voltage V9 of the second capacitor 9 is controlled by switching thyristor 11 on and off. Alternatively, the charging voltage V9 can be controlled by switching the power transistor 6*b* on and off. Namely, the drive circuit 3 can be constructed to receive the input signals R, V8, V9, etc. which are input to the charging trigger circuit 5 in FIG. 1 and to control the duty cycle of the drive signal D based on the input signals. In this case, the charging trigger circuit 5 can be omitted.

Figure 2:
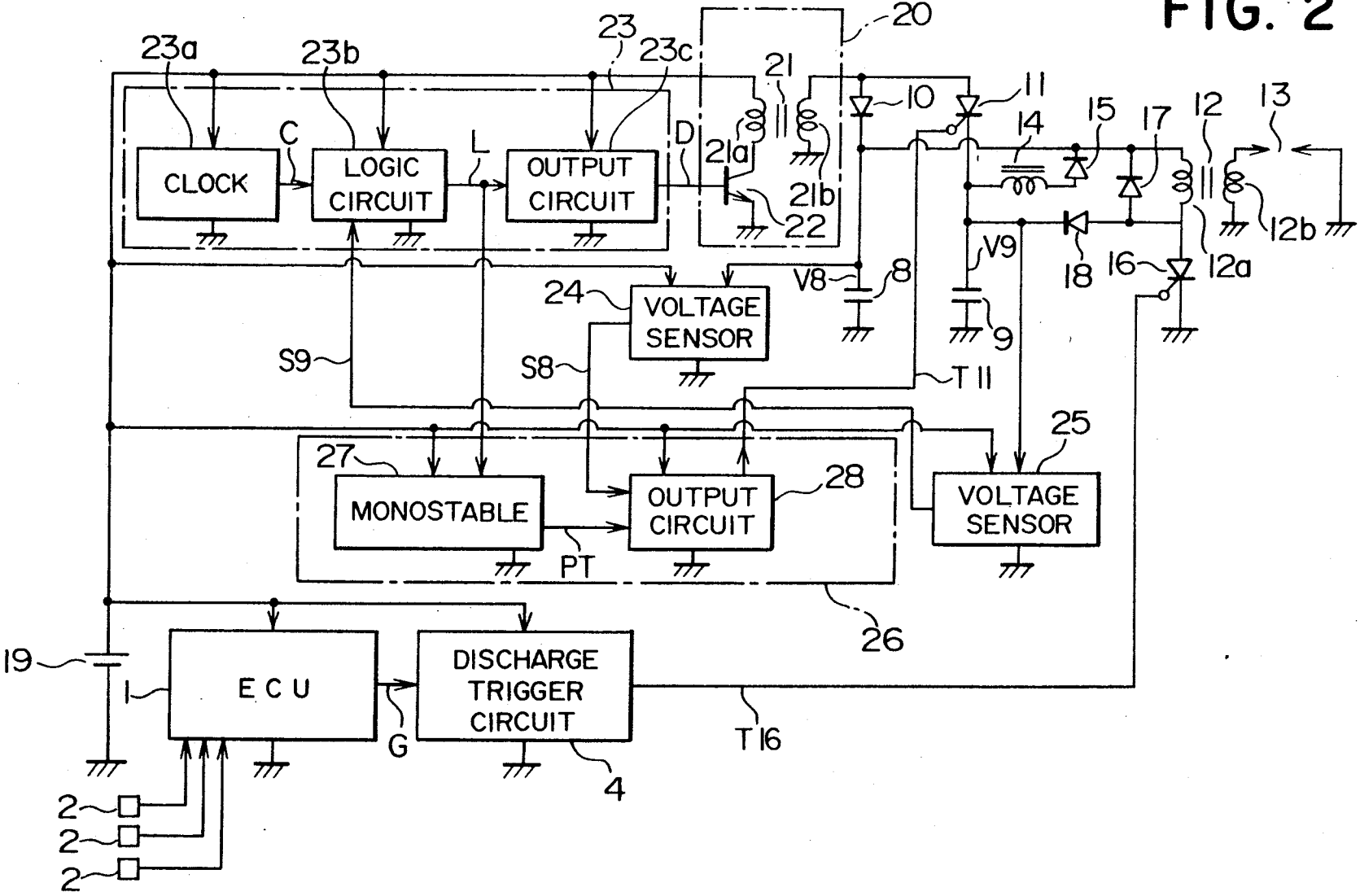
FIG. 2 is a schematic diagram of a second embodiment of an ignition apparatus according to the present invention.

FIG. 2 illustrates a second embodiment of the present invention. The overall structure of this embodiment is similar to that of the embodiment of FIG. 1, and an explanation of components already explained with respect to FIG. 1 will be omitted.

An ECU 1 and other electronic components of this embodiment are powered by a battery 19. A voltage for charging first and second capacitors 8 and 9 is generated by a voltage step-up circuit 20 comprising a step-up transformer 21 and a power transistor 22. The transformer 21 has a primary winding 21*a* and a secondary winding 21*b*. One end of the primary winding 21*a* is connected to the positive terminal of the battery 19, while the other end is connected to the collector of the power transistor 22. One end of the secondary winding 21*b* is connected to the anodes of a diode 10 and a thyristor 11, while the other end is connected to ground. The base of the power transistor 22 is connected to the output terminal of a drive circuit 23 which generates a drive signal D for the power transistor 22, while the emitter of the power transistor 22 is grounded. The structure of the voltage step-up circuit 20 is not limited to that illustrated in FIG. 2, and it can instead have a structure like the voltage step-up circuit 6 of FIG. 1.

A voltage sensing circuit 24 senses the voltage V8 of the first capacitor 8 and generates an output signal S8 having a first level (in this case, a low level) when voltage V8 is below a prescribed voltage VA and having a second level (a high level) when voltage V8 is greater than or equal to the prescribed voltage VA. In this embodiment, the prescribed voltage VA is one sufficient to provide good ignition of the spark plug 13.

The voltage V9 of the second capacitor 9 is sensed by another voltage sensing circuit 25 which generates an output signal S9 having a low level when voltage V9 is below a prescribed voltage VB and a high level when voltage V9 is greater than or equal to the prescribed voltage VB.

The drive circuit 23 includes a clock circuit 23*a* which generates a clock signal C in the form of pulses of a prescribed frequency. The clock signal C is input to a logic circuit 23*b* along with the output signal S9 from voltage sensing circuit 25. The logic circuit 23 generates an output signal L having the logical value S9·C., i.e., NOT S9 AND C. This signal L is provided to an output circuit 23*c* which generates the drive signal D for the power transistor 22. The drive signal D has a high level or a low level when output signal L has a high level or a low level, respectively. The power transistor 22 is turned on when the drive signal D has a high level. Accordingly, when signal S9 indicates that voltage V9 is below the prescribed voltage VB, the power transistor 22 is intermittently turned on at regular intervals determined by the clock signal C.

Thyristor 11, which when turned on allows the second capacitor 9 to be charged, is controlled by a charging trigger circuit 26 based on signal S8 from voltage sensing circuit 24 and signal L from the drive circuit 23. The charging trigger circuit 26 includes a monostable multivibrator 27 which receives the output signal L from logic circuit 23*b* as an input signal. Upon a falling edge of output signal L of the logic circuit 23*b*, the monostable 27 generates a trigger signal PT in the form of a pulse of a predetermined width. The trigger signal PT is input to an output circuit 28 together with the output signal S8 of voltage sensing circuit 24. The output circuit 28 generates a trigger signal T11 for controlling thyristor 11. The trigger signal T11 has a low level whenever signal S8 from voltage sensing circuit 24 has a low level indicating that voltage V8 is below prescribed voltage VA, and the trigger signal T11 comprises pulses generated in synchrony with trigger signal PT when signal S8 has a high level. Thus, the thyristor 11 is turned on and the second capacitor 9 is recharged only after the first capacitor 8 has been charged to the prescribed voltage VA. Preferably trigger signal T11 rises in synchrony with a fall in the input current to the primary winding 21*a* of the transformer 21. The pulse width of trigger signal T11 is preferably short so as to minimize power consumption.

Figure 3:
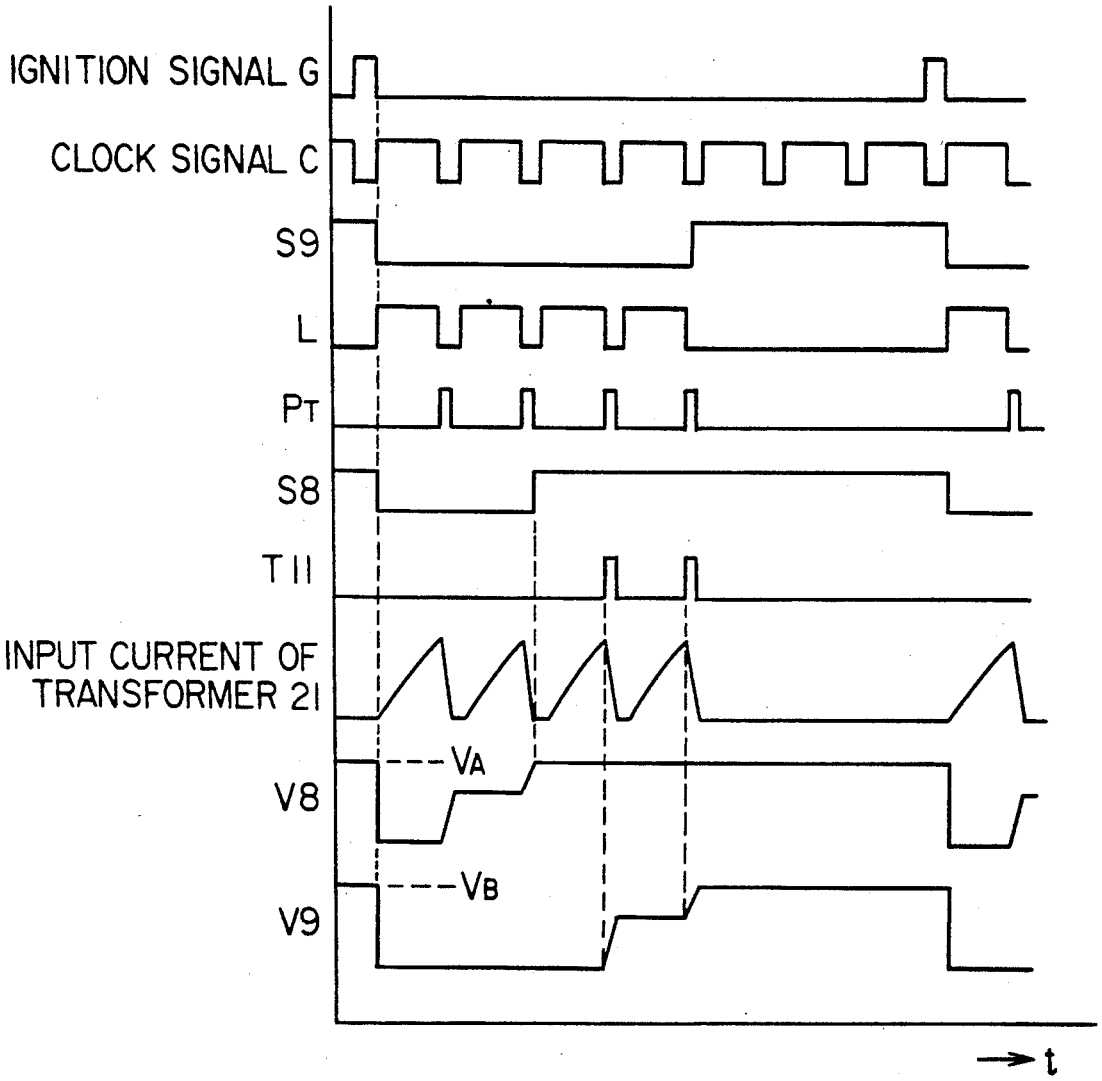
FIGS. 3 and 4 show waveform diagrams illustrating the operation of the embodiment of FIG. 2 at low and high engine speeds, respectively.
Figure 4:
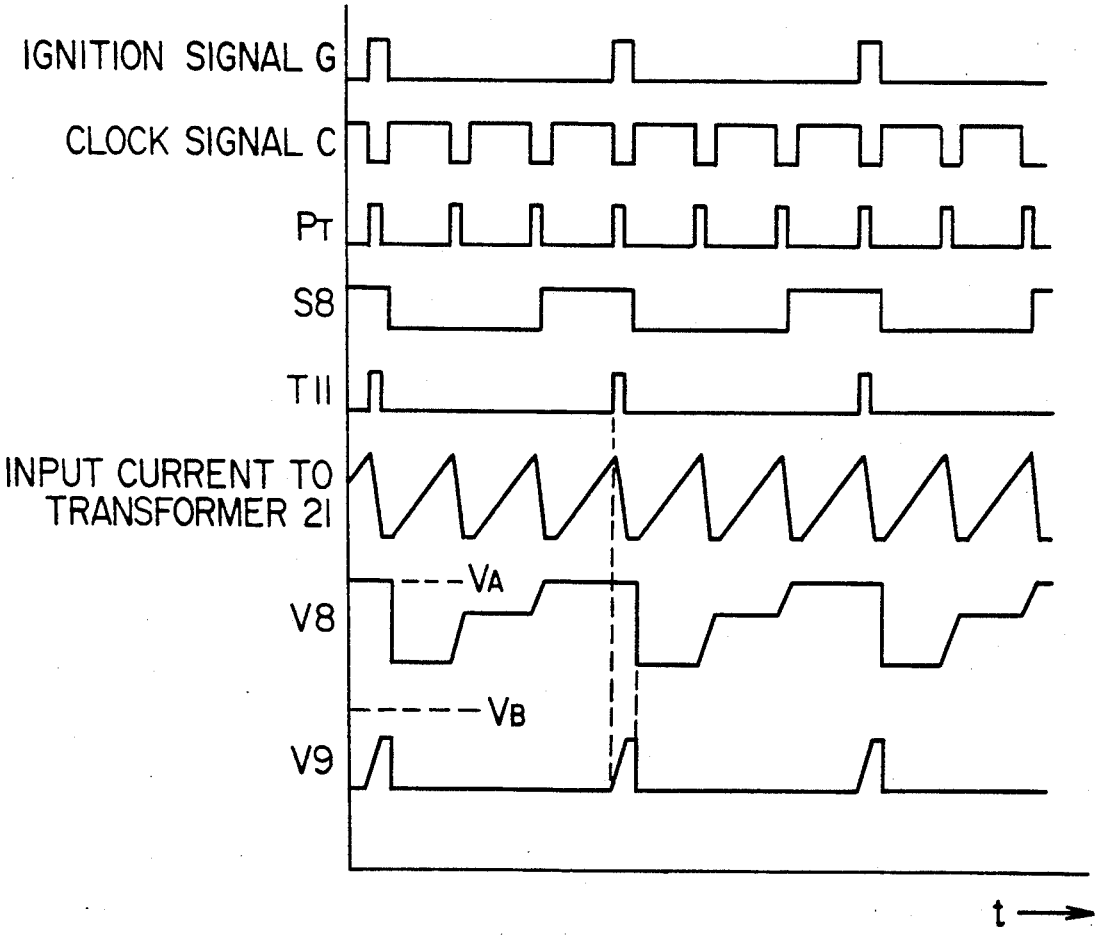

The operation of the embodiment of FIG. 2 will be described while referring to the waveform diagrams in FIGS. 3 and 4. FIG. 3 illustrates operation at a low engine rotational speed, and FIG. 4 illustrates operation at a high engine rotational speed. Low speed operation will first be described. It will be assumed that both of the first and second capacitors 8 and 9 have already been charged to prescribed voltages VA and VB. When the ECU 1 generates an ignition signal G, which is synchronous with the clock signal C, the discharge trigger circuit 4 generates trigger signal T16, which turns thyristor 16 on and causes capacitors 8 and 9 to discharge. The discharge of the capacitors 8 and 9 then causes the spark plug 13 to discharge. Due to the provision of the induction coil 14, the discharge of the spark plug 13 is lengthened in the same manner as described with respect to the first embodiment. Upon discharge of the second capacitor 9, voltage V9 falls below prescribed voltage VB, and the output signal S9 of voltage sensing circuit 25 changes from a low level to a high level. As a result, output signal L of the logic circuit 23*b* oscillates between a high level and a low level in synchrony with the clock signal C, and the drive signal D from the output circuit 23*c* is pulsed on and off to switch the power transistor 22 on and off. Each time the power transistor 22 is turned off, the increased voltage generated by the voltage step-up circuit 20 is applied to the first capacitor 8, and the first capacitor 8 is recharged in a step-wise manner. At the start of recharging of the first capacitor 8, voltage V8 is below prescribed voltage VA, so signal S8 has a low level which keeps thyristor 11 turned off and the second capacitor 9 is not charged while the first capacitor 8 is charging.

When voltage sensing circuit 24 senses that voltage V8 has reached prescribed voltage VA, it raises signal S8 to a high level, and as a result, trigger signal T11 is intermittently generated by the charging trigger circuit 26 to intermittently switch thyristor 11 on and off. Each time the thyristor 11 is turned on, the increased voltage generated by the voltage step-up circuit 20 is applied to the second capacitor 9. Thus, after the first capacitor 8 has been adequately charged, the second capacitor 9 is charged in a step-wise manner. When voltage V9 of the second capacitor 9 reaches prescribed voltage VB, voltage sensing circuit 25 switches signal S9 to a high level, indicating that the second capacitor 9 has been adequately charged. In response, the drive circuit 23 maintains the drive signal D at a low level.

As shown in FIG. 3, at low engine speeds, there is enough time between consecutive occurrences of the ignition signal G that each capacitor can be fully charged to the corresponding prescribed voltage VA or VB.

FIG. 4 illustrates the waveforms of the embodiment of FIG. 2 during high speed operation when the time between consecutive occurrences of the ignition signal G is significantly less than in FIG. 3. If both capacitors 8 and 9 were charged simultaneously, during high speed operation, it would be difficult to ensure that the first capacitor 8 was charged to the prescribed voltage VA between consecutive occurrences of the ignition signal G, and poor ignition could result because of an inadequate voltage stored in the first capacitor 8. However, in the present embodiment, because the first capacitor 8 is charged prior to the second capacitor 9, there is enough time for the first capacitor 8 to be charged to prescribed voltage VA. As the ignition signal G occurs soon after the second capacitor 9 begins charging, the second capacitor 9 is discharged before it has reached prescribed voltage VB, and the second capacitor 9 cannot lengthen the discharge of the spark plug 13 by as much as during low speed operation. However, at a high engine rotational speed, the possibility of misfiring of the engine is extremely low, so there is little or no need to lengthen the discharge time of the spark plug 13. Therefore, the fact that the second capacitor 9 is not charged to its prescribed voltage VB at high engine speeds does not cause any problems.

Thus, by delaying the charging of the second capacitor 9 until the first capacitor 8 has been charged, it is possible to guarantee good ignition at both low and high engine rotational speeds.

In the embodiment of FIG. 2, capacitors 8 and 9 and thyristor 13 each have a terminal connected to ground, there these terminals can instead be connected to the positive terminal of the battery 19.

As in the previous embodiment, when the embodiment of FIG. 2 is applied to a multi-cylinder engine, each cylinder can be equipped with its own ignition coil 12, spark plug 13, and thyristor 16 so that the ignition of each cylinder can be individually controlled.

Figure 5:
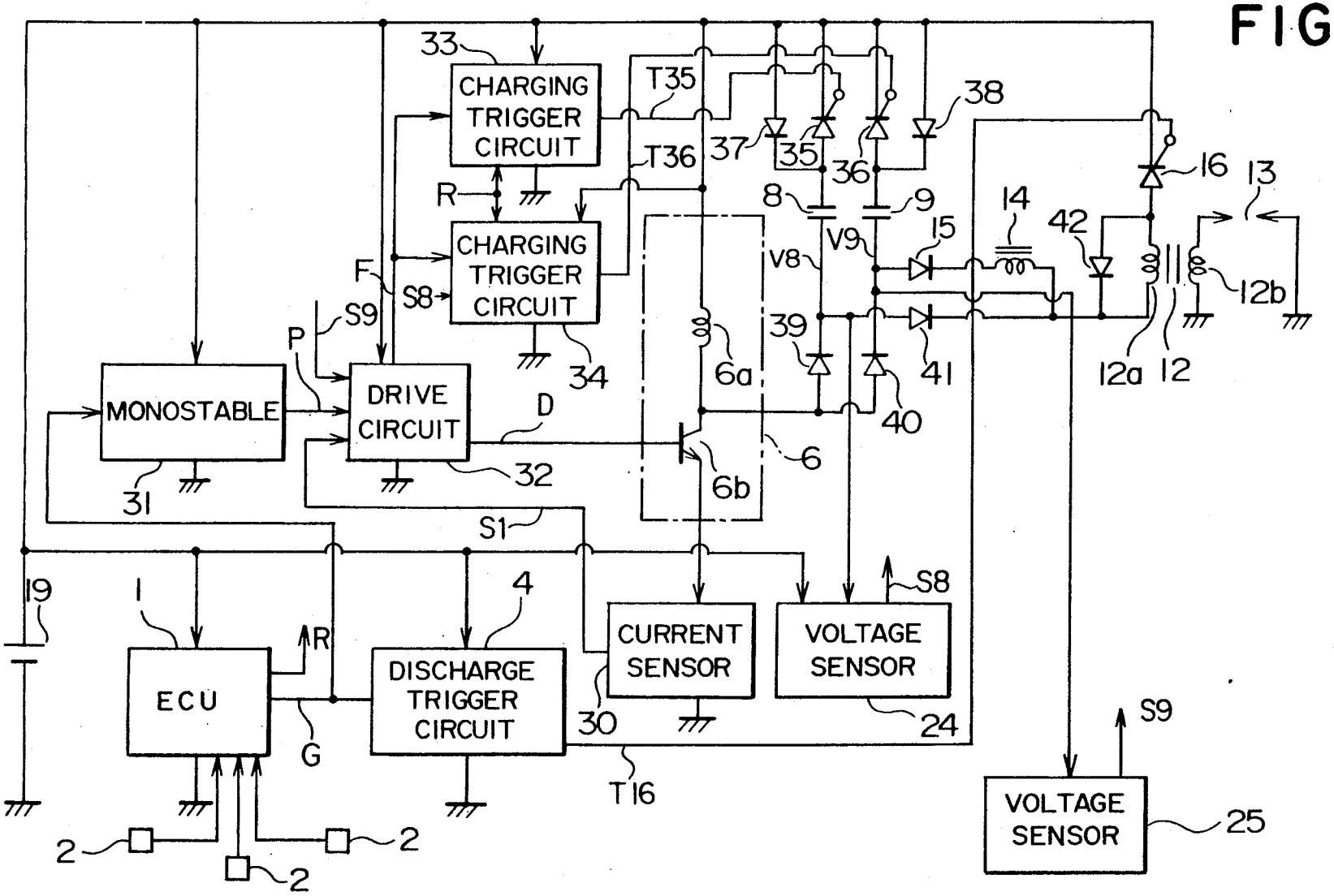
FIG. 5 is a schematic diagram of a third embodiment of an ignition apparatus according to the present invention.
Figure 6:
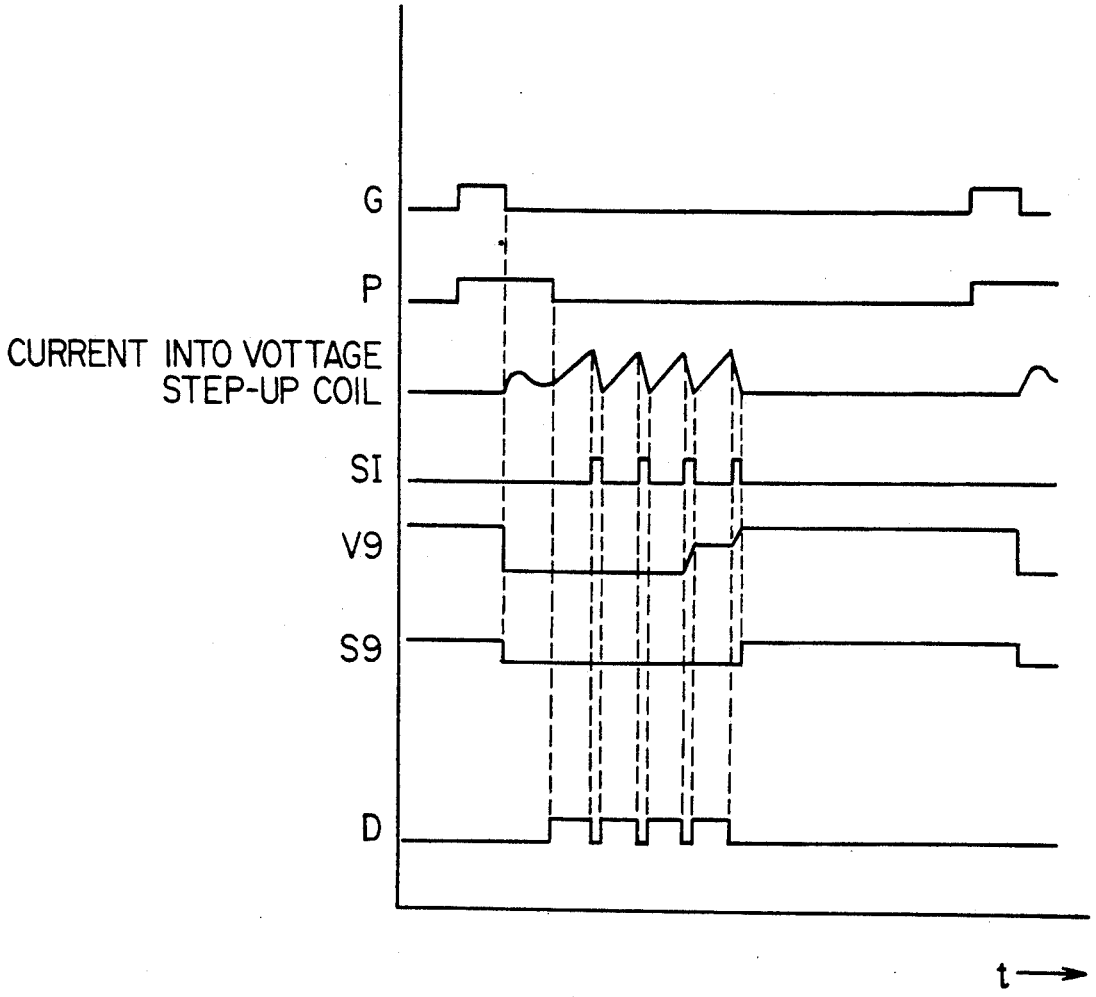
FIG. 6 shows waveform diagrams illustrating the operation of the drive circuit of FIG. 5.

FIG. 5 illustrates another embodiment of the present invention. In this embodiment, the charging voltages of each capacitor can be individually controlled on the basis of an engine operating condition. The overall structure of this embodiment is similar to the embodiments of FIGS. 1 and 2, so the structure and operation of components already described with respect to those figures will be omitted.

An ECU 1 generates an ignition signal G based on the operating condition of the engine as indicated by input signals from various sensors 2. The ECU 1 also generates an output signal R indicating an operating condition of the engine, such as the engine rotational speed, the engine load, or the engine coolant temperature. The ignition signal G is input to a monostable multivibrator 31, which generates a pulse P which rises in synchrony with the ignition signal G but which has a longer pulse width so as to fall a predetermined time after the falling edge of the ignition signal F. This pulse P is input to a drive circuit 32. The drive circuit 32 generates a drive signal D for controlling a voltage step-up circuit 6 for charging first and second capacitors 8 and 9.

The drive signal D is input to the base of a power transistor **6*b* of the voltage step-up circuit 6, which has the same structure as the voltage step-up circuit 6 of FIG. 1, although a voltage step-up circuit like that illustrated in FIG. 2 could instead be employed. When the drive signal D has a high level, the power transistor 6*b* is turned on, and current can flow through the voltage step-up coil 6*a* connected to the collector of the power transistor 6*b*. The emitter of the power transistor 6*b* is connected to a current sensor 30, which generates an output signal SI having a high level each time the current from the emitter of the power transistor 6*b* exceeds a predetermined threshold. Signal SI is input to the drive circuit 32**.

One terminal of the first capacitor 8 is connected to the positive terminal of a battery 19 through a switching element in the form of a thyristor 35, while its other terminal is connected to the collector of the power transistor **6*b* through a diode 39. The anode of thyristor 35 and the cathode of diode 39 are connected to the first capacitor 39. Similarly, one terminal of the second capacitor 9 is connected to the positive terminal of the battery 19 through a switching element in the form of a thyristor 36, and its other terminal is connected to the collector of the power transistor 6*b* through a diode 40 having its cathode connected to the second capacitor 9. Two diodes 37 and 38 are connected in parallel with thyristors 35 and 36, respectively, each diode having its anode connected to the battery 19. Thyristors 35 and 36 are controlled by the trigger signals T35 and T36 generated by two charging trigger circuits 33 and 34**, respectively, to be described below.

An ignition coil 12 has a primary winding **12*a* and a secondary winding 12*b*. The junction of diode 39 and the first capacitor 8 is connected to one end of the primary winding 12*a* through a diode 41, and the junction between diode 40 and the second capacitor 9 is connected to the same end of the primary winding 12*a* through a series circuit of an induction coil 14 and a diode 15. The other end of the primary winding 12*a* is connected to the battery 19 through thyristor 16, which is switched on and off by the discharge trigger circuit 4. A diode 42 is connected between the two ends of the primary winding 12*a* so as to prevent oscillations. The secondary winding 12*b* is connected between ground and a spark plug 13**.

The charging voltage V8 of the first capacitor 8 is sensed by a voltage sensing circuit 24, which generates a signal S8 having a low level when the charging voltage V8 is below a prescribed voltage VA and a high level when the charging voltage V8 reaches the prescribed voltage VA. Similarly, the charging voltage V9 of the second capacitor 9 is sensed by a voltage sensing circuit 25, which generates a signal S9 having a low level when V9 is below a prescribed voltage VB and having a high level when V9 reaches the prescribed voltage VB. Signal S9 is input to the drive circuit 32.

The drive circuit 32 calculates a logical NOR of input signals P, SI, and S9 and generates the drive signal D in accordance with the value of the NOR operation. Namely, the drive signal D has a high level when input signals P, SI, and S9 all have a low value, and the drive signal D has a low level at other times. The pulse width of the output signal P of the monostable 32 is selected to be sufficiently long that the drive signal D will not turn on the power transistor **6*b* while the discharge of the spark plug 13 is being maintained by the current resulting from the discharge of the induction coil 14**.

The drive circuit 32 also generates an output signal F having the same waveform as the drive signal D. This signal F is input to charging trigger circuit 33 which generates trigger signal T35 for controlling thyristor 35 and to charging trigger circuit 34 which generates trigger signal T36 for controlling thyristor 36. Charging trigger circuits 33 and 34 also receive an operating condition signal R generated by the ECU 1 indicating one or more operating conditions of the engine, such as the engine rotational speed, the engine coolant temperature, or the engine load. In addition, charging trigger circuit 34 receives signal S8 from voltage sensing circuit 24. The charging trigger circuits 33 and 34 control the timing and duration of trigger signals T35 and T36 in accordance with the engine operating condition indicated by the operating condition signal R so that each capacitor 8 and 9 will be charged to a voltage suitable for the present operating conditions. Trigger signal T35 has the same waveform as signal F, while trigger signal T36 has the same waveform as signal F when signal S8 has a high level and is off when signal S8 has a low level. Thus, thyristor 36 is not turned on by trigger signal T36 and capacitor 9 does not begin charging until the voltage V8 of capacitor 8 reaches the prescribed voltage VA and signal S8 changes from a low to a high level.

Figure 7:
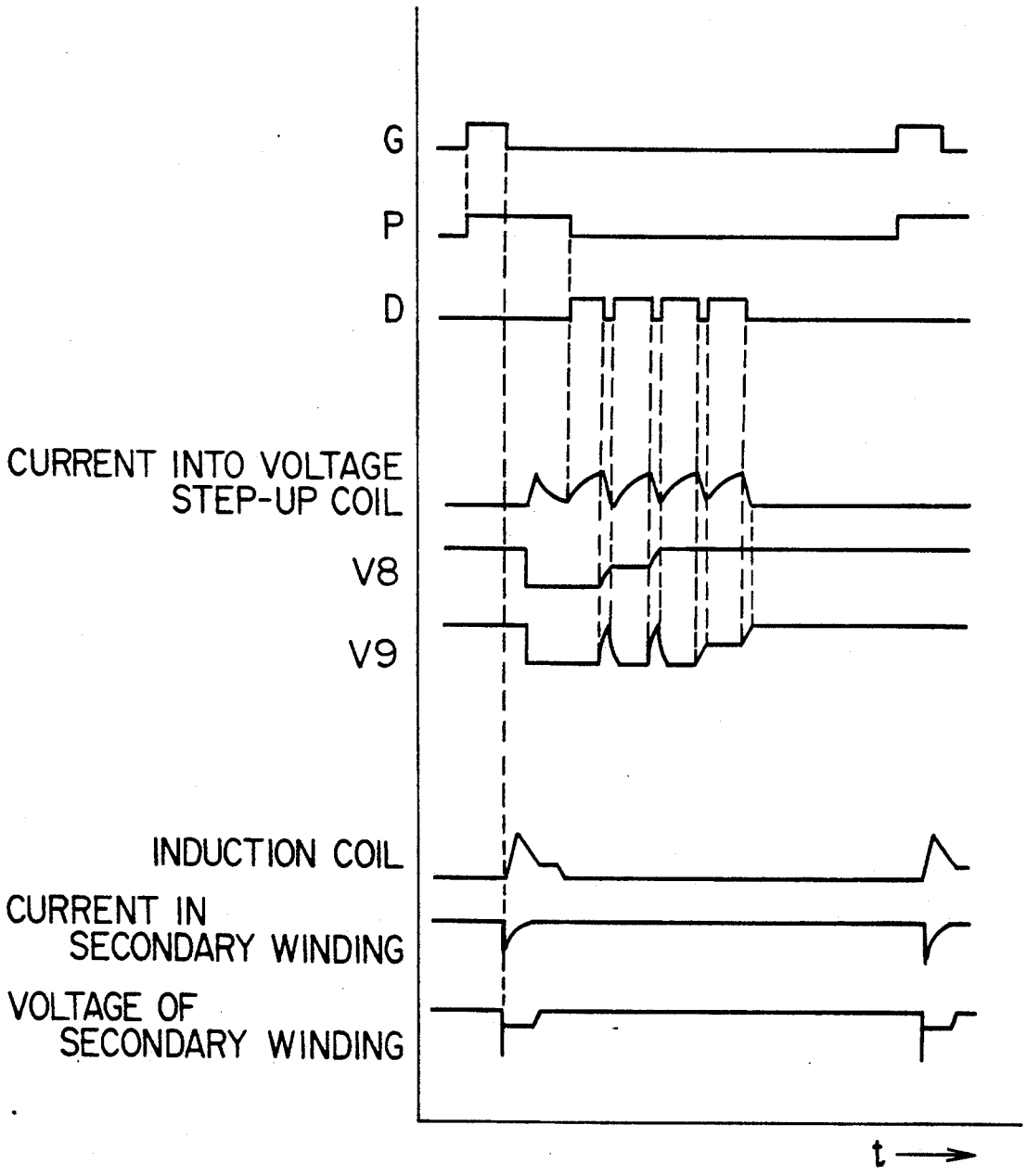
FIG. 7 shows waveform diagrams illustrating the overall operation of the embodiment of FIG. 5.

The operation of the embodiment of FIG. 5 will be explained while referring to the waveform diagrams in FIG. 7. It will be assumed that both of the first and second capacitors 8 and 9 have already been charged to prescribed voltages VA and VB, respectively. When the ignition signal G is generated, the discharge trigger circuit 4 generates trigger signal T16, which turns on thyristor 16 and causes both capacitors 8 and 9 to discharge into the primary winding **12*a* of the ignition coil 12, as a result of which the spark plug 13 discharges. A predetermined time after the falling edge of the ignition signal, when the capacitors 8 and 9 have discharged, pulse P falls, and the drive circuit 32 begins generating the drive signal D to switch power transistor 6*b* on and off and generate an increased voltage in the voltage step-up coil 6*b*. As shown in FIG. 7, trigger signal T36 controls thyristor 36 such that the second capacitor 9 does not begin charging until the first capacitor 8 has reached prescribed voltage VA, and then the second capacitor 9 is charged in a step-wise manner. By charging the first capacitor 8 before the second capacitor 9, the first capacitor 8 can always be charged to the prescribed voltage VA suitable for obtaining a good discharge of the spark plug 13**, even when the engine speed is high and the intervals between consecutive occurrences of the ignition signal G is short.

The on times of thyristors 35 and 36 can be varied in accordance with the operating conditions of the engine as indicated by the operating condition signal. For example, at a high engine rotational, it is difficult for misfiring to take place, so the on times of thyristor 35 and/or thyristor 36 can be controlled to reduce the charging voltage V8 of the first capacitor 8 and/or the charging voltage V9 of the second capacitor compared to the charging voltages at a low engine speed. Thus, it is possible for each of the charging voltages V8 and V9 to be independently set to the minimum required value in accordance with the present operating conditions, thereby significantly reducing the electric power consumed by the apparatus.

The power transistor 6*a* is switched off by the drive circuit 32 each time the emitter current sensed by the current sensor 30 reaches a predetermined level. Therefore, the power transistor 6*b* is prevented from damage due to excessive currents, and it is possible to reduce the capacity of the power transistor 6*b*.

Depending on the manner in which thyristors 35 and 36 are controlled by the charging trigger circuits 33 and 34, a voltage difference may develop between the first and second capacitors 8 and 9. However, diodes 15 and 41 prevent one capacitor from discharging to the other.

As shown in the embodiments of FIGS. 2 and 5, the voltage set-up circuit 6 or 20, the capacitors 8, 9, and the thyristor 16 can be commonly connected to ground or the positive terminal of the battery 19.

As in the case of the previous embodiments, when this embodiment is applied to a multi-cylinder engine, each cylinder can be equipped with its own ignition coil 12, spark plug 13, and thyristor 16 so that the ignition of each cylinder can be individually controlled.

Although in the embodiment of FIG. 5, the first and second capacitors 8, 9 are sequentially charged by use of a voltage signal S8 from the voltage sensing circuit 24, they can instead be controlled based solely on the operating condition signal R, without use of the voltage signal S8, such that the thyristor 36 is turned on by the charging trigger circuit 34 after the lapse of a predetermined time from the instant when the thyristor 35 has been first turned on.

What is claimed is:

1. An ignition apparatus for an internal combustion engine comprising:

an ignition coil having a primary winding and a secondary winding;

a spark plug connected to the secondary winding of the ignition coil;

a first capacitor connected to the primary winding of the ignition coil;

a second capacitor;

an induction coil connected between the second capacitor and the primary winding of the ignition coil for lengthening a discharge of the spark plug;

a voltage source connected to the first and second capacitors for generating a charging voltage for the first and second capacitors;

an operating condition sensor for sensing an operating condition of an engine; and voltage control means responsive to the operating condition sensor for varying the charging voltage of the second capacitor based on the operating condition sensed by the operating condition sensor.

2. An apparatus as claimed in claim 1 wherein the operating condition sensor senses the rotational speed of an engine, and the voltage control means decreases the charging voltage of the second capacitor as the engine speed increases.

3. An apparatus as claimed in claim 1 wherein the operating condition sensor senses the rotational speed of an engine, and the voltage control means increases the charging voltage of the second capacitor when the engine speed is unstable.

4. An apparatus as claimed in claim 1 wherein the operating condition sensor senses the temperature of an engine, and the voltage control means increases the charging voltage of the second capacitor as the engine temperature decreases.

5. An apparatus as claimed in claim 1 wherein the voltage control means charges the second capacitor after the first capacitor has been charged to a prescribed voltage.

6. An apparatus as claimed in claim 1 wherein the voltage control means includes means for controlling the charging voltage of the first capacitor according to an operating condition of the engine.

7. An apparatus as claimed in claim 6 wherein the operating condition sensor senses the rotational speed of an engine, and the voltage control means decreases the charging voltage of the first capacitor as the engine speed increases.

8. An ignition apparatus for an internal combustion engine comprising:

an ignition coil having a primary winding and a secondary winding;

a spark plug connected to the secondary winding of the ignition coil;

a first capacitor connected to the primary winding of the ignition coil;

a second capacitor;

an induction coil connected between the second capacitor and the primary winding of the ignition coil for lengthening a discharge of the spark plug;

a voltage source connected to the first and second capacitors for generating a charging voltage for the first and second capacitors; and voltage control means for charging the second capacitor after the first capacitor has been charged to a prescribed charging voltage.

9. An ignition control method for an internal combustion engine comprising:

charging a first capacitor to a first voltage;

sensing an operating condition of the engine;

charging a second capacitor to a second voltage in accordance with the engine operating condition;

discharging the first capacitor into a primary winding of an ignition coil; and discharging the second capacitor through an induction coil into the primary winding of the ignition coil.

10. A method as claimed in claim 9 further comprising sensing the rotational speed of an engine and increasing the second voltage when the rotational speed is unstable.

11. A method as claimed in claim 9 further comprising sensing the rotational speed of an engine and decreasing the second voltage as the rotational speed increases.

12. A method as claimed in claim 9 further comprising sensing the temperature of the engine and increasing the second voltage as the temperature decreases.

13. A method as claimed in claim 9 further comprising charging the second capacitor after charging the first capacitor to the first voltage.

14. A method as claimed in claim 9 further comprising varying the first voltage in accordance with an operating condition of the engine.

* * * * *